US008906269B2

(12) United States Patent
Lee et al.

(10) Patent No.: US 8,906,269 B2
(45) Date of Patent: Dec. 9, 2014

(54) PASTE AND SOLAR CELL USING THE SAME

(75) Inventors: In Jae Lee, Seoul (KR); Jin Gyeong Park, Seoul (KR); Jun Phil Eom, Seoul (KR); Soon Gil Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 468 days.

(21) Appl. No.: 13/259,513

(22) PCT Filed: Apr. 7, 2010

(86) PCT No.: PCT/KR2010/002132

§ 371 (c)(1),
(2), (4) Date: Dec. 7, 2011

(87) PCT Pub. No.: WO2010/117207

PCT Pub. Date: Oct. 14, 2010

(65) Prior Publication Data

US 2012/0097237 A1 Apr. 26, 2012

(30) Foreign Application Priority Data

Apr. 7, 2009 (KR) ..... 10-2009-0029832
Nov. 2, 2009 (KR) ..... 10-2009-0105181

(51) Int. Cl.

| | |
|---|---|
| ***H01B 1/06*** | (2006.01) |
| ***H01B 1/18*** | (2006.01) |
| ***H01B 1/16*** | (2006.01) |
| ***H01B 1/22*** | (2006.01) |
| ***H01B 1/24*** | (2006.01) |

(52) U.S. Cl.

CPC .. *H01B 1/22* (2013.01); *H01B 1/18* (2013.01); *H01B 1/16* (2013.01); *H01B 1/24* (2013.01)

USPC ..... 252/508; 252/503; 252/512; 136/244; 136/255; 136/256; 136/261; 438/57

(58) Field of Classification Search

CPC ..... H01L 31/022425; H01L 31/022441

USPC ..... 252/503, 512, 508; 136/244, 255, 256, 136/261; 438/57

See application file for complete search history.

(56) References Cited

U.S. PATENT DOCUMENTS 8,398,896 B2 * 3/2013 Brenner et al. ..... 252/512
8,425,807 B2 * 4/2013 Senda et al. ..... 252/512

(Continued)

FOREIGN PATENT DOCUMENTS

EP 1400987 A2 3/2004
JP 2000-090733 A 3/2000

(Continued)

OTHER PUBLICATIONS

Office Action dated Dec. 27, 2012 in Chinese Application No. 201080025083.X, filed Apr. 7, 2010.

(Continued)

*Primary Examiner* — Khanh Tuan Nguyen

(74) *Attorney, Agent, or Firm* — Saliwanchik, Lloyd & Eisenschenk

(57) ABSTRACT

The present invention relates to a paste and a solar cell using the paste. The paste according to an embodiment of the present invention comprises three and more than aluminum powders having different shape, size, and type, a glass frit, and an organic vehicle, wherein the aluminum powers includes a first powder of 40 to 50 wt %, a second powder of 20 to 30 wt %, and a third powder of 0.1 to 2 wt %, and the first to third powders have one or more than different shapes of a globular shape, a flat shape, a nano shape, and combinations thereof.

19 Claims, 3 Drawing Sheets

(56) References Cited

U.S. PATENT DOCUMENTS

| | | | | |
|---|---|---|---|---|
| 2006/0273287 | A1 | 12/2006 | Young et al. | |
| 2007/0221270 | A1* | 9/2007 | Watsuji et al. | 136/256 |
| 2009/0229665 | A1* | 9/2009 | Young et al. | 136/261 |

FOREIGN PATENT DOCUMENTS

| | | | | |
|---|---|---|---|---|
| JP | 2000-090734 | A | 3/2000 | |
| JP | 2002-090733 | A | 3/2002 | |
| JP | 2004-134775 | * | 4/2004 | H01L 31/04 |
| JP | 2004-146154 | A | 5/2004 | |
| JP | 2005-317898 | A | 11/2005 | |
| JP | 2008-108716 | A | 5/2008 | |

OTHER PUBLICATIONS

Supplementary European Search Report dated Aug. 24, 2012 in European Application No. 10761868.8, filed Apr. 7, 2010.

International Search Report in International Application No. PCT/KR2010/002132, filed Apr. 7, 2010.

* cited by examiner

Fig. 4

| FIRST POWDER OF GLOBULAR SHAPE (%) | SECOND POWDER OF GLOBULAR SHAPE (%) | THIRD POWDER OF FLAT SHAPE (%) | Al SURFACE RESISTANCE (mΩ/□) | Bowing (mm) | BSF (μm) |
|---|---|---|---|---|---|
| 35 | 45 | 0.5 | 14.58 | 1.021 | 5.66 |
| 40 | 24.5 | 0.5 | 12.66 | 0.971 | 6.24 |
| 47 | 24.5 | 0.5 | 11.52 | 0.865 | 6.71 |
| 47 | 30 | 0.5 | 11.98 | 0.989 | 6.03 |
| 47 | 24.5 | 1.0 | 12.50 | 0.998 | 6.35 |
| 47 | 24.5 | 2.0 | 13.42 | 0.981 | 6.02 |
| 50 | 35.5 | 0.5 | 11.88 | 1.025 | 5.78 |
| 53 | 35 | 2.0 | 15.65 | 1.025 | 5.36 |
| 53 | 35.5 | 1.5 | 14.56 | 1.065 | 5.93 |

PASTE AND SOLAR CELL USING THE SAME

CROSS-REFERENCE TO RELATED APPLICATIONS

This application is the U.S. national stage application of International Patent Application No. PCT/KR2010/002132, filed Apr. 7, 2010, which claims priority to Korean Application Nos. 10-2009-0029832, filed Apr. 7, 2009, and 10-2009-0105181, filed Nov. 2, 2009, the disclosures of each of which are incorporated herein by reference in their entirety.

TECHNICAL FIELD

The present invention relates to a paste and a solar cell including a paste.

BACKGROUND ART

Global circumstance goes bad and gas price rises so that a solar cell configured to convert the energy of sunlight directly, which is a kind of an infinite clean energy, into electricity by the photovoltaic effect receives public attention.

The solar cell is a device that converts the energy of sunlight directly into electricity.

Since the solar cell has different structure from a conventional chemical battery, the solar cell is sometimes called 'physical battery'.

The solar cell uses two kinds of semiconductor material, i.e., P-type and N-type semiconductors, to generate electricity.

In detail, if the sun lights up the solar cell, electrons and holes are generated in the solar cell. These electronic charges are moved to P or N electrode. Because of movements of electronic charges, there is potential difference between the P and N electrodes. This photovoltaic effect makes electricity, and a current may flows through a load if the load is coupled to the solar cell.

According to manufactured materials, the solar cell can be roughly split into two types: one includes a silicon semiconductor; and the other includes a compound semiconductor.

Herein, the silicon semiconductor may be divided into a morphous (crystalline) type and an amorphous type. Recently, various types of silicon semiconductor are newly developed Regarding of technology related to the solar cell, much of the industry is focused on the most cost efficient technologies in terms of cost per generated power by increasing efficiency of the solar cell.

For example, solar cells having an efficiency of at least 20% or thin solar cells de-creasing their cost per unit area have been developed.

Presently, a silicon semiconductor is generally used for the solar cells. Particularly, a single crystal solar cell or a poly crystal solar cell made from a morphous silicon semiconductor is widely used because it has high efficiency and reliability.

Among various type solar cells, a morphous silicon solar cell using a silicon wafer is widespread-commercially used. Herein, the morphous silicon solar cell has an efficiency of over 15% which is one of highest efficiencies in commercial devices.

Many methods for manufacturing the morphous silicon solar cell are suggested, but it is most widely used to form an electrode through a screen printing technique.

Referring to FIG. 1, a conventional method for manufacturing a morphous silicon solar cell is described.

As shown in FIG. 1, the solar cell includes a P-N junction formed based on a silicon wafer substrate 10. There are an N+ layer 20 formed on an upper surface of the silicon wafer substrate 10 and a P+ layer 50 attached to a lower surface of the silicon wafer substrate 10.

Over the N+ layer 20, a foreside electrode 40 and an anti reflection layer are formed. Under the P+ layer 50, the reverse side electrode 60 is formed by using an aluminum (AL) paste.

A tapping electrode 70 configured to solder a tab for electronically connecting each solar cell to a solar cell module is formed by a screen printing technique. For completion, an annealing process performed in a temperature of 900 to 1000° C.

As above described, the conventional solar cell receives sunlight so that electrons and holes are generated. Referring to FIG. 1, these electrons and holes move to P+ layer and N+ layer so that difference between potentials of the P+ layer and the N+ layer is occurred. If a load is coupled to a solar cell, current may flow due to the difference between potential.

Herein, an aluminum paste using for electrodes is formed as following processes. During the annealing process, III-family aluminum (AL) is diffused into the silicon wafer substrate 10 to form a back surface field (BSF) as the P+ layer. Silicon wafer is electrically contacted to the aluminum paste.

Additionally, an aluminum electrode can be functioned as improving an internal field, blocking recombination of electrons, gathering holes as a majority carrier, and reflecting long wavelength sheen of sunlight.

In order to improve back-surface field (BSF) characteristics and electricity included in the aluminum electrode, a thickness of the aluminum electrode should be increased. However, as the thickness is increased, the aluminum electrode may become plastic during a module assembly process. Further, if a bowing phenomenon can be occurred, an electrical performance of the solar cell goes bad and a silicon wafer is destroyed.

DISCLOSURE OF INVENTION

Technical Problem

An embodiment of the present invention is to provide a compound-type electrode paste including various aluminum power having different shape, size, and type, which is configured to increase a surface connected to a silicon wafer, increase a spreading area, form a back-surface field effectively, improve electronic characteristics by mixing particles having different size to increase a bulk density of aluminum powder, and minimize a shrinkage of particles by reducing thermal expansion of metals during annealing process.

An embodiment of the present invention is to provide a paste using an aluminum powder of low purity configured to have electronic characteristics substantially equal to those using an aluminum power of high purity, reduce manufacturing cost, increase printability, reducing a bowing phenomenon after plasticity to increase efficiency of solar cell, and increase an electrical performance of solar cell.

An embodiment of the present invention is to provide an electrode for use in a solar cell by using a paste.

Solution to Problem

In an embodiment of the present invention, a paste comprises three and more than aluminum powders having different shape, size, and type, a glass frit, and an organic vehicle. Increasing a bulk density of aluminum particles improves electric conductivity, prevents thermal expansion to minimize a bowing phenomenon, and forms a back-surface field (BSF) effectively.

Particularly, the aluminum powders have one or more than different shapes of a globular shape, a flat shape, a nano shape, and combinations thereof. Even though the aluminum powders have the same shape, particles of various size and diameter may be included in the aluminum powders.

In addition, the aluminum powers according to an embodiment of the present invention includes a first powder of 40 to 50 wt %, a second powder of 20 to 30 wt %, and a third powder of 0.1 to 2 wt %.

The first powder may include a powder of globular shape having 0.1 to 2 μm diameter, the second powder may include a powder of globular shape having 0.5 to 20 μm diameter, and the third powder may include a powder of flat shape having 20 to 50 μm size.

In the paste according to an embodiment of the present invention, the glass frit is 1 to 20 wt % and the organic vehicle 20 to 50 wt %.

The present invention may provide a solar cell comprising a back-surface electrode includes the paste described above.

The paste according to an embodiment of the present invention is effectively applied to a photo detector such as a solar cell, a photo diode, and so on, but it is well known to people skilled in the art that the paste can be applied to various semiconductor devices.

Meanwhile, an embodiment of the present invention is to provide a paste comprising an aluminum powder, a glass frit, and an organic vehicle, comprising a carbon particle having a globular shape.

The carbon particle may include plural carbon particles having different diameters, wherein an average diameter of the carbon particles is 0.05 to 5 μm.

The carbon particle can be 0.1 to 10 wt % of total paste weight.

The carbon particle may include one and more than materials having carbon characteristics of a nitrocellulose, a carbon black, a graphite powder, and an aluminum carbide in a low temperature and having thermal decomposition in a high temperature.

The aluminum powder can be a mixture including a single-type particle or two or more than type particles having different size, wherein an average size of the particles is 1 to 10 μm.

The aluminum powder may be 50 to 90 wt % of total paste weight.

The glass frit may include one or more than materials of $PbO—SiO_2$, $PbO—SiO_2—B_2O_3$, $ZnO—SiO_2$, $ZnO—B_2O_3—SiO_2$, $Bi_2O_3—B_2O_3—ZnO—SiO_2$, and combinations thereof.

The glass frit may be 1 to 20 wt % of total paste weight.

The glass frit can have a softening point of 300 to 600° C. and an average size of 0.5 to 10 μm.

The organic vehicle comprises a polymer including one selected from the group of Acrylate, Ethyl cellulose, Nitro cellulose, a polymer of Ethyl cellulose and Phenolic resin, Rosin, and Poly methacrylate, and a solution including one or more than selected from the group of Butyl Cabitol Acetate, Butyl Cabitol, Butyl Cellosolve, Butyl Cellosolve Acetate, Propylene Glycol Monomethyl Ether, Dipropylene Glycol Monomethyl Ether, Propylene Glycol Monomethyl Ether Propionate, Ethyl Ester Propionate, Terpineol, Propylene Glycol Monomethyl Ether Acetate, Dimethylamino Formaldehyde, Methylethylketone, Gamma Butyrolactone, Ethyl lactate, and Texanol.

The organic vehicle further comprises a phosphorus dispersing agent, a thixotropic agent, a leveling agent, and a deforming agent.

The organic vehicle can be 10 to 30 wt % of total paste weight.

The present invention provides a solar cell comprising an electrode manufactured by using the paste.

The electrode may be a back-surface electrode.

Advantageous Effects of Invention

The present invention, using a compound-type electrode paste including various aluminum power having different shape, size, and type, has effects on increasing a surface connected to a silicon wafer, increasing a spreading area, forming a back-surface field effectively, improving electronic characteristics by mixing particles having different size to increase a bulk density of aluminum powder, and minimizing a shrinkage of particles by reducing thermal expansion of metals during annealing process.

Particularly, the present invention effectively forms the back-surface field to reduce a leakage current, implements recombination blocking of electrons, and reduces a resistance to increase a short circuit current so that photovoltaic conversion efficiency and fidelity increase.

Further, in the present invention, increasing a bulk density of aluminum particles improves electric conductivity as well as increases a short circuit current and fidelity and prevents thermal expansion to minimize a bowing phenomenon against a single aluminum back-surface electrode.

In addition, a paste according to an embodiment of the present invention and an electrode of solar cell using the paste have electronic characteristics substantially equal to those using an aluminum power of high purity, though using an aluminum powder of low purity. The paste and the electrode of the present invention use less carbon particles so that uniformity of back surface is maintained or increased. Based on decrease or block of bowing phenomenon in a wafer, contact resistance becomes lower and efficiency of solar cell is increased.

BRIEF DESCRIPTION OF DRAWINGS

FIG. 4 is a table showing test results about characteristics of pastes manufactured by using three or more than aluminum particles according to an embodiment of the present invention.

BEST MODE FOR CARRYING OUT THE INVENTION

While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Hereinafter, reference will now be made in detail to various embodiments of the present invention, examples of which are illustrated in the accompanying drawings and described below.

The present invention relates to a paste included in an aluminum back surface electrode, and more particularly, to a compound paste using various aluminum powders having different shape, size, and type.

As above described, the present invention includes three and more than aluminum powders having different shape, size, and type, a glass frit, and an organic binder. In an embodiment of the present invention described later, a paste is fabricated by combining three aluminum powders.

Aluminum powders according to an embodiment of the present invention are called a first power, a second powder, and a third power. Herein, the first to third powders have different shapes, for example, one or more than of a globular shape, a flat shape, a nano shape, and combinations thereof.

In an embodiment of the present invention, a first powder of 40 to 50 wt %, a second powder of 20 to 30 wt %, and a third powder of 0.1 to 2 wt % against total weight of the aluminum powers can be included. herein, the first powder may include a powder of globular shape having 0.1 to 2 μm diameter, the second powder may include a powder of globular shape having 0.5 to 20 μm diameter, and the third powder may include a powder of flat shape having 20 to 50 μm size.

Further, an aluminum electrode paste according to an embodiment of the present invention further comprises a glass frit and an organic vehicle.

The glass frit may include one or more than materials of $PbO—SiO_2$, $PbO—SiO_2—B_2O_3$, $ZnO—SiO_2$, $ZnO—B_2O_3—SiO_2$, $Bi_2O_3—B_2O_3—ZnO—SiO_2$, and combinations thereof. The glass frit may be 1 to 20 wt % of total paste weight.

The glass frit can have a softening point of 300 to 600° C. and an average size of 0.5 to 10 μm.

The organic vehicle comprises an organic binder including one of Ethyl cellulose, Acrylate, Epoxy resin, Alkyd resin, and etc. and a solvent including one of Terpineol, Texanol, and etc. The organic vehicle may include one of a deforming agent, a dispersing agent, and the combination thereof. The organic vehicle can be in range of 20 to 50 wt % of total paste weight.

Figure 1:
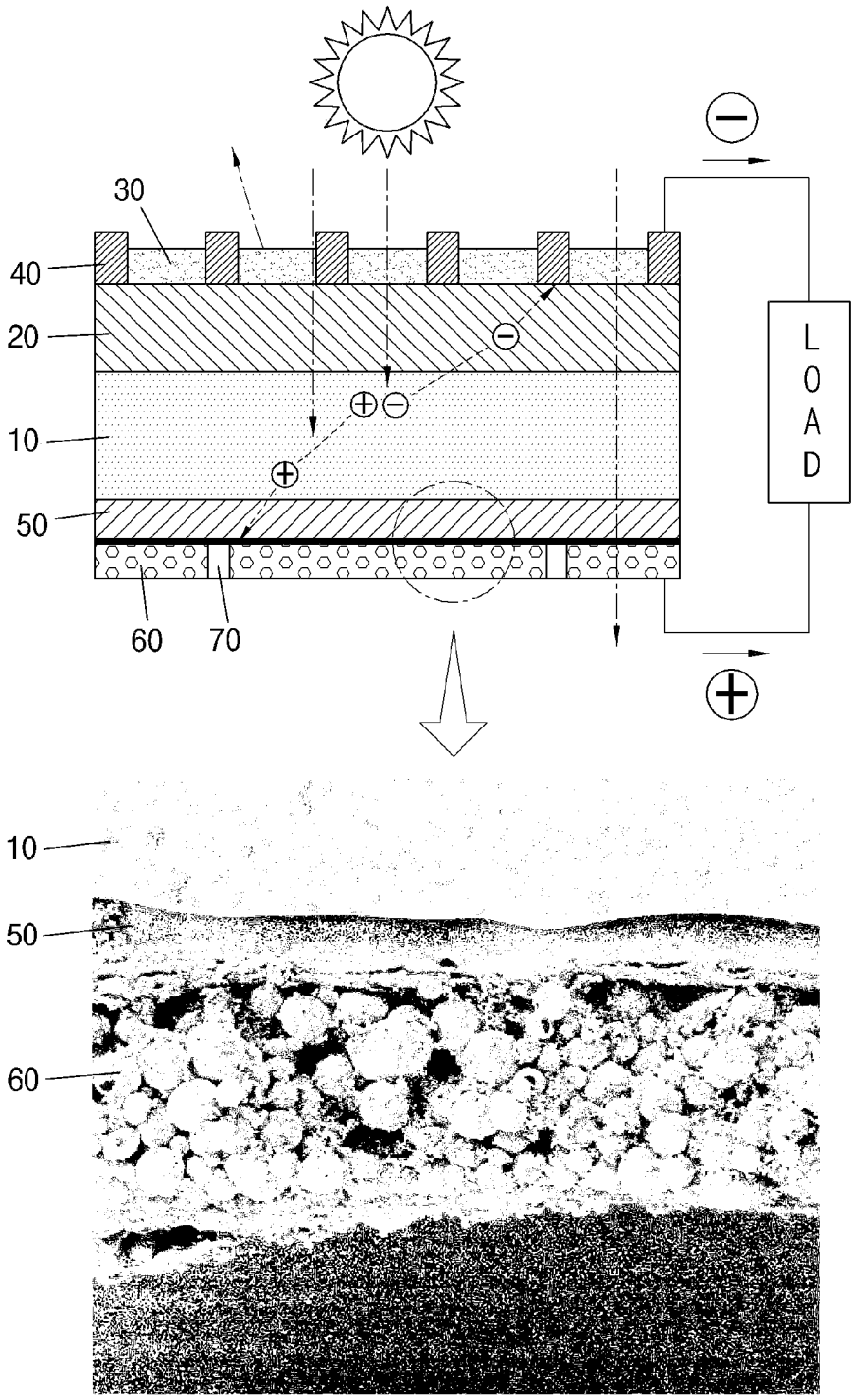
FIG. 1 is a block diagram describing a conventional solar cell.
Figure 2:
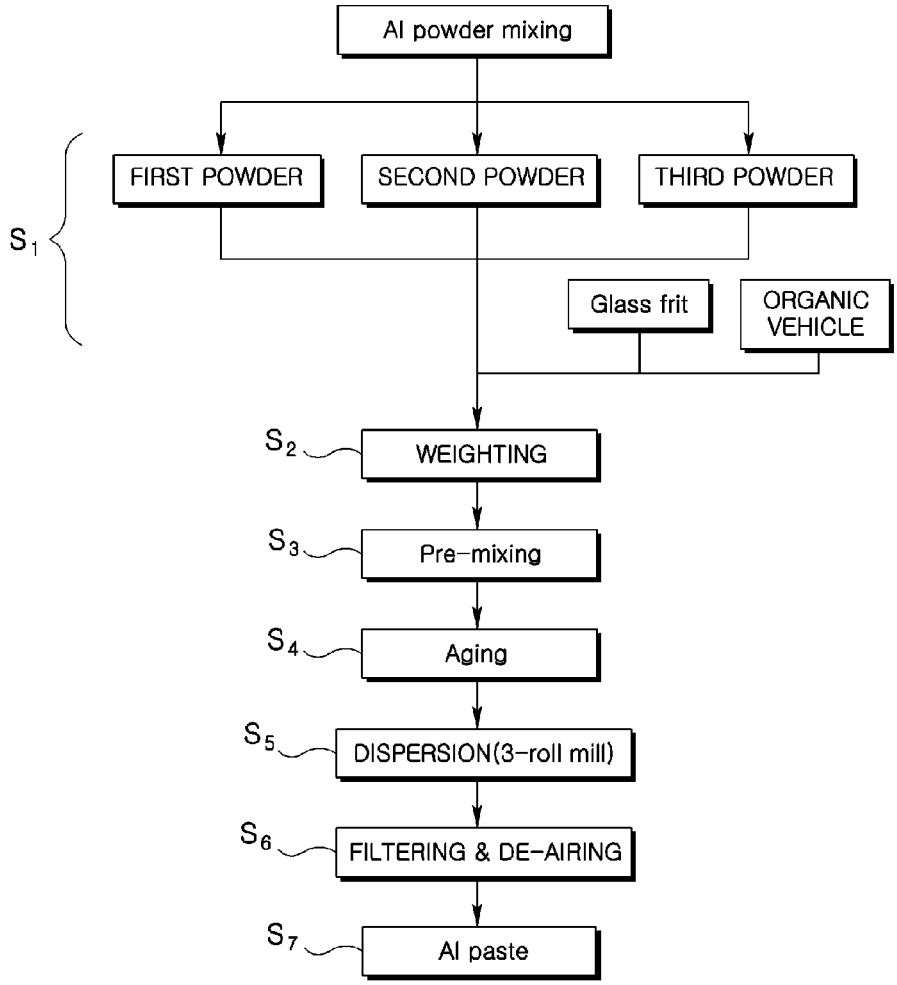
FIG. 2 is a flow chart showing a method for manufacturing a paste according to an embodiment of the present invention.

FIG. 2 is a flow chart showing a method for manufacturing a paste according to an embodiment of the present invention.

For manufacturing an aluminum electrode paste according to the present invention, in S1 step, an organic resin served as an organic binder is dissolved in a solvent to make an organic vehicle. The organic vehicle is typically a solution of one or more resin binders in one or more suitable solvents. Also, for making an aluminum powder, first, second, and third powders are separately provided.

Three or more than aluminum powders of 40 to 50 wt %, 20 to 30 wt %, and 0.1 to 2 wt %, a glass fit of 1 to 20 wt %, and the organic vehicle 20 to 50 wt % are weighed and then premixed, referring to S2 and S3 steps.

Herein, an amine, an acid, and a dipolar dispersant can be mixed to increase particle dispersibility of compound material made by above premixing step.

After S3 step, the compound material is aged for 1 to 12 hours to effective dispersion. (S4)

The aged compound material is mixed or dispersed mechanically by a paste mixer, a planetary mill, and a 3 roll mill. Then, filtering and de-airing process are performed to make an aluminum paste. (S5 to S7)

Figure 3:
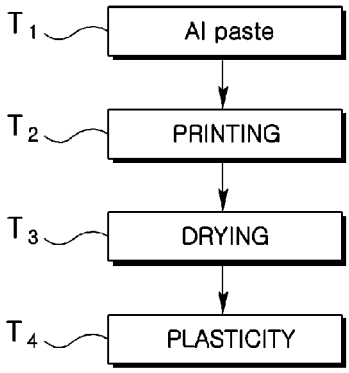
FIG. 3 is a flow chart depicting a method for manufacturing a back-surface electrode of solar cell by using the paste shown in FIG. 2.

FIG. 3 is a flow chart depicting a method for manufacturing a back-surface electrode of solar cell by using the paste shown in FIG. 2.

The paste according to the present invention is screen-printed on a surface of silicon wafer having 100 to 500 μm. Instead of the screen printing, the paste can be coated more than one time by a doctor blade or a slit coater using a roller or a die moved in uniformed speed and pressure.

The paste screen-printed or coated as above described is dried in 80 to 200° C. temperature. An IR rapid thermal treatment in 700 to 900° C. temperature is performed to the dried paste and the silicon wafer so that a back-surface electrode is formed.

FIG. 4 is a table showing test results about characteristics of pastes manufactured by using three or more than aluminum particles according to an embodiment of the present invention. Herein, as items of characteristics, a surface resistance, a bowing phenomenon, and a BSF layer property are included.

As shown, in the present invention comprising three type powers, i.e., a first powder of globular shape, a second powder of globular shape, and a third powder of flat shape, the best performances are occurred in a surface resistance, a bowing phenomenon, and a BSF layer property when the first powder of 40 to 50 wt %, the second powder of 20 to 30 wt %, and the third powder of 0.1 to 2 wt % are mixed.

These results say that an internal photo reflectance can be increased in response to addition of different type flakes to affect efficiency of solar cell.

Generally, a BSF layer having over 6 μm thickness is required as a back-surface electrode included in a morphous solar cell. As the BSF layer is thick, the BSF layer can block recombination of electrons and serve as a reflector to increase photoelectric conversion efficiency of the solar cell. There is no limitation to thickness of the BSF layer, however larger-the-better characteristics are required. In the present invention, by mixing 3 or more than different type aluminum powders, the BSF layer is effectively formed and the larger-the-better characteristics are increased.

Additionally, the solar cell requires a surface resistance of under 15 mΩ/sq. As a surface resistance becomes lower, more electricity goes through. If more electricity moves through, efficiency of solar cell is increased because holes are collected effectively.

Further, during a module assembly process after a cell fabricated, a bowing phenomenon having a size of over 1 mm causes damage or defect. In a view of efficiency of solar cell, the surface resistance and the bowing phenomenon requires smaller-the-better characteristics.

In the present invention, by mixing 3 or more than different type aluminum powders, the surface resistance and the bowing phenomenon are minimized so that the smaller-the-better characteristics are decreased.

As above described, 3 or more than different type aluminum powders according to an embodiment of the present invention are mixed. Thus, compared with a conventional art using a single aluminum powder, the present invention may provide improvement of BSF layer, electric conductivity, and bowing phenomenon.

Hereinafter, other embodiments of the present invention are described in detail.

The present invention relates to a paste comprising an aluminum powder, a glass frit, an organic vehicle, and a carbon particle.

In a conventional conductive paste, an organic vehicle including ethyl cellulose and so on binds inorganic solidity component in the paste and increases efficiency of screen printing. However, since particles including a carbon perform an oxidation-reduction (redox) reaction with oxidized particles presented on an aluminum surface of the paste, the particles may improve electronic characteristics of aluminum having high oxidation property. That is, carbon particles presented around aluminum particles in the paste are oxidized and combusted in 500 to 700° C. temperature. At this time, an oxide film is reduced because the oxidation-reduction reaction between the carbon particles and the aluminum particles is occurred. Accordingly, sintering between aluminum powders is expedited, and inherent resistance of electrode is decreased so that diffusion property of aluminum powder is improved.

Additionally, in a high temperature, carbon particles are disappeared by a thermal decomposition after plasticity to form voids. Since the voids can serve as a buffer when an aluminum back surface film is heat-shrunk, the voids improve a bow phenomenon.

Further, though a wafer thickness becomes less than 200 μm, the aluminum paste according to the present invention can be applied.

Thus, the carbon particle includes one and more than materials having carbon characteristics of a nitrocellulose, a carbon black, a graphite powder and aluminum carbide in a low temperature and having thermal decomposition in a high temperature.

The carbon particle is in range of 0.1 to 10 wt % of total paste weight. If the carbon particle is less than 0.1 wt %, effects obtained by adding the carbon particle in the paste cannot be expected. Otherwise, if the carbon particle is more than 10 wt %, a lot of voids are generated to decrease uniformity of electronic field at a back surface.

Further, because the solar cell has many micro voids, moisture can be permeated into voids presented in an aluminum back surface after a module assembly process with a solar cell is finished. Then, electronic conductivity goes bad, and crack in the aluminum back surface can be generated so that reliability of solar cell module becomes lower.

By using small amount of carbon particles, printability of aluminum paste is improved rather than a paste using only Nitro cellulose.

By using carbon particles of various sizes rather than single size carbon particles, resistance characteristic of back surface field is improved because sintering is expedited. Herein, it is preferable that average diameter of various size carbon particles is in a range of 0.05 to 5 μm.

If an average diameter of carbon particles is less than 0.05 μm, there is no improvement of bowing phenomenon on the paste; otherwise, if the average diameter is more than 5 μm, uniformity of electronic field at a back surface is decreased.

In an embodiment of the present invention, it is preferable that the aluminum power includes single size particles or two or more than various size aluminum particles. Herein, the paste is manufactured by using the aluminum power comprising aluminum particles having different shape, size, and type so that the paste is configured to increase a surface connected to a silicon wafer, increase a spreading area, form a back-surface field effectively, improve electronic characteristics by mixing particles having different size to increase a bulk density of aluminum powder, and minimize a shrinkage of particles by reducing thermal expansion of metals during annealing process.

In the present invention, by mixing aluminum powders having different size, the surface resistance and the bowing phenomenon are minimized so that the smaller-the-better characteristics in the solar cell are decreased. During a module assembly process after a cell fabricated, a bowing phenomenon having a size of over 1 mm causes damage or defect. In a view of efficiency of solar cell, the surface resistance and the bowing phenomenon requires smaller-the-better characteristics.

In the present invention, the glass frit includes one or more than materials of $PbO—SiO_2$, $PbO—SiO_2—B_2O_3$, $ZnO—SiO_2$, $ZnO—B_2O_3—SiO_2$, $Bi_2O_3—B_2O_3—ZnO—SiO_2$, and combinations thereof.

The glass frit is in a range of 1 to 20 wt % of total paste weight; and more preferably, in a range of 1 to 10 wt %.

If the glass frit is less than 1 wt %, adhesive strength and bowing phenomenon go bad; otherwise, if the glass frit is more than 20 wt %, electronic characteristics go worse so that efficiency of solar cell is decreased. Herein, the glass frit has a softening point of 300 to 600° C. temperature and an average size of 0.5 to 10 μm. If characteristics of the glass frit are individually kept in ranges, fill factor and sintered density can be maximized.

The present invention, through mechanically mixing the organic vehicle and inorganic component in the paste, implements improvement of consistency characteristic and viscosity and rheological characteristics As the organic vehicle, an organic vehicle used for a paste included in a conventional solar cell can be used, for example, include a compound material of a polymer and a solution.

The polymer may include one of Acrylate, Ethyl cellulose, Nitro cellulose, a polymer of Ethyl cellulose and Phenolic resin, Rosin, and Poly methacrylate. Preferably, Ethyl cellulose is more applicable.

The solution may include one or more than one among Butyl Cabitol Acetate, Butyl Cabitol, Butyl Cellosolve, Butyl Cellosolve Acetate, Propylene Glycol Monomethyl Ether, Dipropylene Glycol Monomethyl Ether, Propylene Glycol Monomethyl Ether Propionate, Ethyl Ester Propionate, Terpineol, Propylene Glycol Monomethyl Ether Acetate, Dimethylamino Formaldehyde, Methylethylketone, Gamma Butyrolactone, Ethyl lactate, and Texanol. Preferably, Butyl Cabitol Acetate is more applicable.

Additionally, the organic vehicle further comprises a phosphorus dispersing agent, a thixotropic agent, a leveling agent, and a deforming agent. Herein, the thixotropic agent can include a polymer/organic material such as urea, amide, urethane, and so on, or an inorganic material such as silica, and etc.

The organic vehicle is in a range of 20 to 30 wt % of total paste weight. If the organic vehicle is less than 20 wt %, printability becomes worse due to lack of organic material amount; otherwise, if the organic vehicle is more than 30 wt %, consistency characteristic goes bad so that film can be damaged after printing process.

Herein, a method for manufacturing the paste described above is depicted.

First, an polymer resin including one of Acrylate, Ethyl cellulose, Nitro cellulose, Ethyl cellulose, and etc. is dissolved and premixed in a solvent such as Butyl Cabitol Acetate to provide an organic vehicle. In the organic vehicle, various size carbon particles are mixed.

In compound material including the organic vehicle and various carbon particles, various aluminum powders having different size and the glass frit are premixed. Then, an amine, an acid, and a dipolar dispersant can be mixed to increase particle dispersibility of compound material made by above premixing step.

The compound material is aged for 1 to 12 hours to effective dispersion.

The aged compound material is mixed or dispersed mechanically by a paste mixer, a planetary mill, and a 3 roll mill. Then, filtering and de-airing process are performed to make an aluminum paste.

Further, the present invention provides a solar cell electrode fabricated through paste-printing, drying and plasticity processes.

Except for processes or steps for fabricating the paste, a conventional method for forming a solar cell can be applied as paste-printing, drying and plasticity processes for manufacturing a solar cell electrode according to the present invention.

Herein, the solar cell electrode can be a back surface electrode. The paste-printing is performed in a way of screen printing. The paste screen-printed or coated as above described is preferably dried in 80 to 200° C. temperature during 1 to 30 minutes.

For plasticity, a rapid thermal treatment in 700 to 900° C. temperature is performed for 5 second to 1 minute. The printing is performed by a screen printer configured to print on surface of single crystal semiconductor having a thickness of 200 μm in uniformed speed and pressure.

Hereinafter, other embodiments of the present invention are described in details. Through these embodiments, the present invention can be clearly described, but the embodiments cannot limit claim scope.

Embodiment 1

Aluminum powder of 0.7 oxidation and 75 wt % and 5 μm diameter carbon particles of 5 wt % are mixed, and the glass frit of 10 wt % and the organic vehicle of the rest portion are further used to manufacture a paste.

Embodiment 2

5 μm diameter carbon particles of 1 wt % are mixed, and others are same to the embodiment 1

Embodiment 3

5 μm diameter carbon particles of 0.5 wt % are mixed, and others are same to the embodiment 1

Embodiment 4

0.5 μm diameter carbon particles of 1 wt % instead of 5 μm diameter carbon particles are mixed, and others are same to the embodiment 1

Embodiment 5

5 μm diameter carbon particles of 0.75 wt % and 0.5 μm diameter carbon particles of 0.25 wt % instead of 5 μm diameter carbon particles are mixed, and others are same to the embodiment 1

Embodiment 6

5 μm diameter carbon particles of 0.5 wt % and 0.5 μm diameter carbon particles of 0.5 wt % instead of 5 μm diameter carbon particles are mixed, and others are same to the embodiment 1

Embodiment 7

5 μm diameter carbon particles of 0.25 wt % and 0.5 μm diameter carbon particles of 0.75 wt % instead of 5 μm diameter carbon particles are mixed, and others are same to the embodiment 1

Comparative Example 1

There is no carbon particle. Except for carbon particle, others are same to the embodiment 1

Comparative Example 2

There is no carbon particle, and aluminum powder having oxidation of 0.2 is used. Others are same to the embodiment 1

Other Conditions in Experiments

Pastes according to embodiments 1 to 7 and comparative examples 1 and 2 are individually screen-printed on silicon wafers having a thickness of 180 μm after texturing. Then, the pastes and the silicon wafers are dried in about 160° C. temperature for 20 minutes, and a rapid thermal treatment is performed in 850° C. temperature for 30 seconds to manufacture back-surface electrodes in the solar cells.

The back-surface electrodes in the solar cells manufactured by using the pastes according to embodiments 1 to 7 and comparative examples 1 and 2 are tested in views of performance and efficiency. Test results are described in Tables 1 and 2.

TABLE 1

| | Al surface resistance (mΩ/□) | BSF resistance (Ω/□) | Bowing phenomenon (mm) |
|---|---|---|---|
| Embodiment 1 | 12.61 | 5.39 | 0.99 |
| Embodiment 2 | 13.05 | 5.63 | 1.19 |
| Embodiment 3 | 13.99 | 6.59 | 1.23 |
| Embodiment 4 | 14.76 | 7.01 | 1.27 |
| Embodiment 5 | 13.26 | 6.98 | 1.17 |
| Embodiment 6 | 13.76 | 6.52 | 1.35 |
| Embodiment 7 | 14.75 | 6.23 | 1.24 |
| Comparative example 1 | 15.32 | 8.01 | 1.52 |
| Comparative example 2 | 13.05 | 5.55 | 1.45 |

TABLE 2

| | FF | Eff. (ratio) |
|---|---|---|
| Embodiment 1 | 0.772 | 1.08 |
| Embodiment 7 | 0.761 | 1.06 |
| Comparative example 1 | 0.74 | 1.00 |
| Comparative example 2 | 0.757 | 1.06 |

The efficiency shown in Table 2 means photovoltaic conversion efficiency after solar cells are fabricated, estimated by Solar simulator. The Fill Factor (FF) is defined as the ratio (given as percent) of the actual maximum obtainable power to the theoretical (not actually obtainable) power in solar cell technology.

The surface resistance and the BSF resistance are measured by 4-point probe. Also, bowing phenomenon characteristic is measured in a center of surface by a dial gauge.

Referring to Table 1, cases that aluminum powders including high oxidation are mixed with carbon particles having different sizes are equal to or better in view of BSF resistance than cases that aluminum powders having low oxidation are mixed. On the contrary, in case when aluminum powders having high oxidation are used without any carbon particles, BSF resistance is the highest.

Since oxidation films around the aluminum powders suppress sintering and dispersion, resistance when powders having high oxidation are used is higher than others even though solar cells are manufactured by same method.

Because of carbon particles having thermal decomposition in a high temperature, bowing phenomenon can be improved according to mixture of carbon particles.

Further, by mixing small amount of carbon particles, reduction of paste's printability can be blocked.

According to the experimental results, even though aluminum powders having high oxidation are used, efficiency of the paste can be high if carbon particles to remove an oxidation film around aluminum particles are used. Further, by adjusting size and compound ratio of aluminum powders and carbon particles, the paste configured to improve contact resistance and efficiency may be developed.

It will be apparent to those skilled in the art that various modifications and variation can be made in the present invention without departing from the spirit or scope of the invention. Thus, it is intended that the present invention cover the modifications and variations of this invention, provided they come within the scope of the appended claims and their equivalents.

INDUSTRIAL APPLICABILITY

The present invention provides a paste configured to improve electronic characteristics by mixing particles having different size to increase a bulk density of aluminum powder, and minimize shrinkage of particles by reducing thermal expansion of metals during annealing process, and a solar cell comprising an electrode fabricated by using the paste.

The invention claimed is:

1. A paste comprising an aluminum powder, a glass frit, and an organic vehicle, comprising a carbon particle having a globular shape, wherein the aluminum powder includes a first powder of 40 to 50 wt %, a second powder of 20 to 30 wt %, and a third powder of 0.1 to 2 wt %.

2. The paste according to claim 1, comprising a plurality of carbon particles having different diameters, wherein an average diameter of the plurality of carbon particles is in a range of 0.05 to 5 μm.

3. The paste according to claim 1, wherein the amount of carbon particle is in a range of 0.1 to 10 wt % of total paste weight.

4. The paste according to claim 1, wherein the carbon particle includes one or more materials of a nitrocellulose, a carbon black, a graphite powder, and an aluminum carbide.

5. The paste according to claim 1, wherein the aluminum powder is a mixture including a single-type particle or more than two types of particles having different size, wherein an average size of the particles is in a range of 1 to 10 μm.

6. The paste according to claim 1, wherein the aluminum powder is in a range of 50 to 90 wt % of total paste weight.

7. The paste according to claim 1, wherein the glass frit includes one or more materials of $PbO—SiO_2$, $PbO—SiO_2B_2O_3$, $ZnO—SiO_2$, $ZnO—B_2O_3—SiO_2$, $Bi_2O_3—B_2O_3—ZnO—SiO_2$, and combinations thereof.

8. The paste according to claim 1, wherein the glass frit is in a range of 1 to 20 wt % of total paste weight.

9. The paste according to claim 1, wherein the glass frit has a softening point of 300 to 600° C. and an average size of 0.5 to 10 μm.

10. The paste according to claim 1, wherein the organic vehicle comprises:

a polymer including one selected from the group of acrylate, ethyl cellulose, nitro cellulose, a polymer of ethyl cellulose and phenolic resin, rosin, and poly methacrylate; and a solution including one or more selected from the group of butyl carbitol acetate, butyl carbitol, butyl cellosolve, butyl cellosolve acetate, propylene glycol monomethyl ether, dipropylene glycol monomethyl ether, propylene glycol monomethyl ether propionate, ethyl ester propionate, erpineol, propylene glycol monomethyl ether acetate, dimethylamino formaldehyde, methylethylketone, gamma butyrolactone, ethyl lactate, and texanol.

11. The paste according to claim 10, wherein the organic vehicle further comprises a phosphorus dispersing agent, a thixotropic agent, a leveling agent, and a deforming agent.

12. The paste according to claim 1, wherein the organic vehicle is in a range of 20 to 30 wt % of total paste weight.

13. A solar cell comprising an electrode manufactured by using the paste according to claim 1.

14. The solar cell according to claim 13, wherein the electrode is a backsurface electrode.

15. The paste according to claim 1, wherein the carbon particle includes a material that has a carbon shape in a low temperature and is decomposed in a high temperature.

16. The paste according to claim 1, wherein the first to third powders have one or more different shapes of a globular shape, a flat shape, a nano shape, and combinations thereof.

17. The paste according to claim 1, wherein the first powder includes a powder of globular shape having diameter of 0.1 to 2 μm.

18. The paste according to claim 1, wherein the second powder includes a powder of globular shape having diameter of 0.5 to 20 μm.

19. The paste according to claim 1, wherein the third powder includes a powder of flat shape having size of 20 to 50 μm.

* * * * *